US006257868B1

(12) United States Patent
Durst et al.

(10) Patent No.: US 6,257,868 B1
(45) Date of Patent: Jul. 10, 2001

(54) METHOD AND DEVICE FOR THE COMBUSTION OF LIQUID FUEL

(76) Inventors: Franz Durst, Eichenstrabe 12, 91094 Langensendelbach; Michael Keppler, Rennestrase 41/614, 91054 Erlangen; Miroslaw Weclas, Blumenstrasse 7, 91094 Langensendelbach, all of (DE)

( * ) Notice: Subject to any disclaimer, the term of this patent is extended or adjusted under 35 U.S.C. 154(b) by 0 days.

(21) Appl. No.: 09/308,202

(22) PCT Filed: Nov. 10, 1997

(86) PCT No.: PCT/DE97/02622

§ 371 Date: Jul. 19, 1999

§ 102(e) Date: Jul. 19, 1999

(87) PCT Pub. No.: WO98/21523

PCT Pub. Date: May 22, 1998

(30) Foreign Application Priority Data

Nov. 13, 1996 (DE) ..... 196 46 957

(51) Int. Cl.[7] ..... F23D 3/40

(52) U.S. Cl. ..... 431/7; 431/170; 431/328; 431/11; 431/215; 431/346

(58) Field of Search ..... 431/7, 326, 327, 431/328, 329, 170, 181, 187, 215, 346, 11, 243; 122/4 D; 432/179

(56) References Cited

U.S. PATENT DOCUMENTS

| | | | | |
|---|---|---|---|---|
| 1,846,978 | * | 2/1932 | Parker et al. | 431/7 |
| 2,095,065 | | 10/1937 | Hays | 431/7 |
| 4,047,876 | * | 9/1977 | Rice | 431/7 |
| 4,133,632 | | 1/1979 | Nakano | 431/328 |
| 5,141,432 | * | 8/1992 | Bell et al. | 431/7 |
| 5,165,884 | * | 11/1992 | Martin et al. | 431/7 |
| 5,522,723 | * | 6/1996 | Durst et al. | 431/328 |
| 5,624,252 | * | 4/1997 | Charles et al. | 431/7 |
| 5,709,174 | | 1/1998 | Ledjeff et al. . | |
| 5,890,886 | * | 4/1999 | Doker et al. | 431/328 |

FOREIGN PATENT DOCUMENTS

| | | |
|---|---|---|
| 43 17 554 | 12/1994 | (DE) . |
| 43 22 109 | 1/1995 | (DE) . |
| 0 524 736 A2 | 1/1993 | (EP) . |
| 2 041 181 | 9/1980 | (GB) . |

* cited by examiner

*Primary Examiner*—Ira S. Lazarus
*Assistant Examiner*—Josiah C. Cocks
(74) *Attorney, Agent, or Firm*—Fish & Richardson P.C.

(57) ABSTRACT

The invention relates to a method for the combustion of liquid fuel (F), especially oil. Wherein the liquid fuel (F) is distributed by means of a distribution device (1) and directed to a downstream reactor with porous means (6) having a communicating pore volume, whose Pecler number allows for flame expansion and full combustion of the liquid fuel (F) inside the porous means (6).

52 Claims, 5 Drawing Sheets

METHOD AND DEVICE FOR THE COMBUSTION OF LIQUID FUEL

Figure 1:
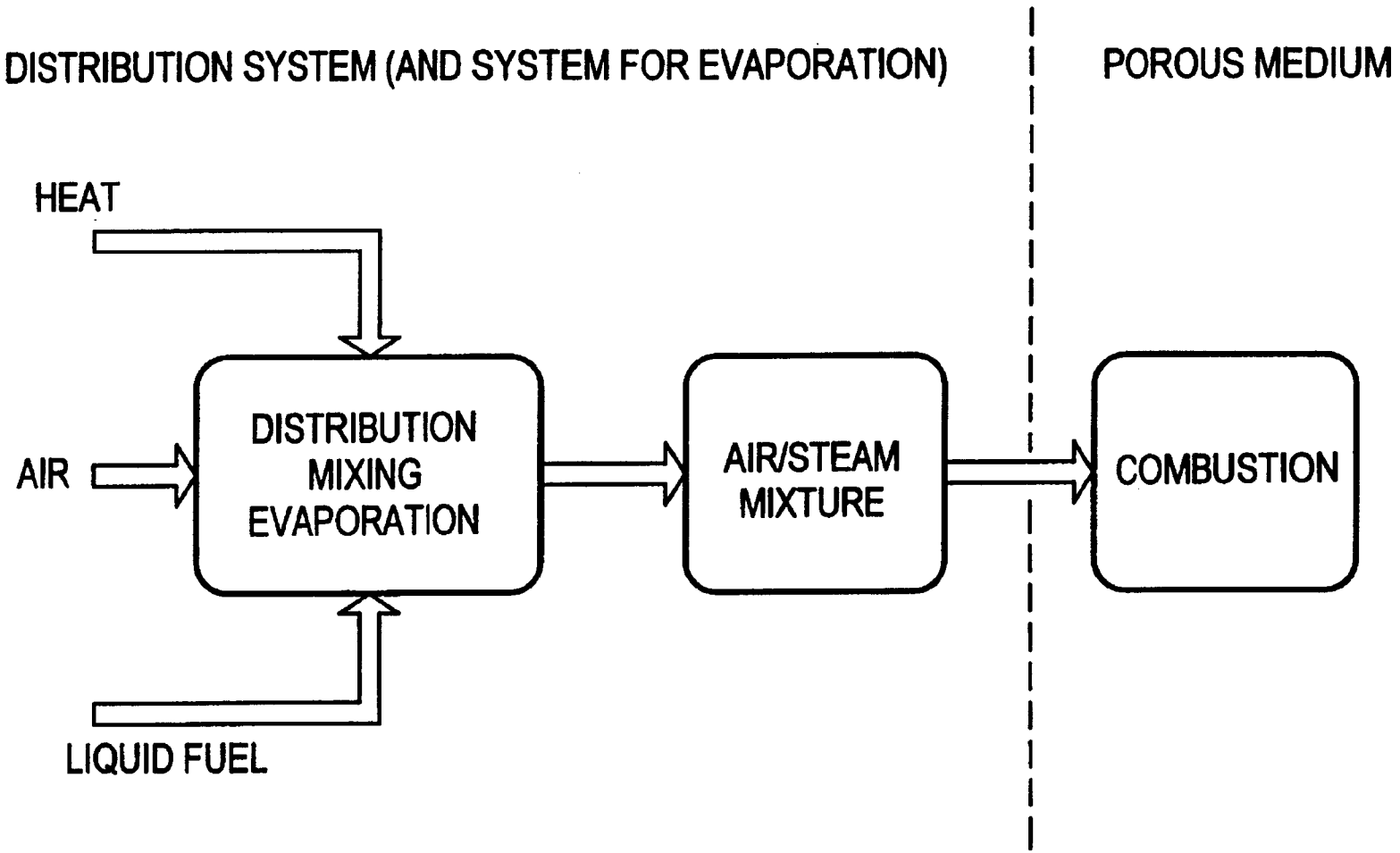

The invention relates to a process and an appliance for the combustion of liquid fuel, in particular oil.

A burner, which can be operated with a gas/air mixture as fuel, is known from DE 43 22 109 A1. In this burner, the so-called pore burner technology is used. This technology differs from all the usual combustion processes in that the gas/air mixture is burnt in the hollow spaces of an inert porous material.

Because of the positive heat transport properties of the porous material, such a burner is characterized by a low emission of pollutants and a very large range of excess air number and output (up to 1:20). In addition, the exhaust gases can be very effectively cooled by a heat exchanger embedded in the porous material so that very high efficiencies and an improved fuel utilization are ensured. Such burner/heat exchanger combinations only require about 1/10 of the installation volume of known systems.

The known burner cannot, however, be operated with liquid fuels such as oil or the like.

EP 0 524 736 A2 reveals a process and an appliance for carrying out a controlled reaction in a porous matrix. In these, gas or vapor is guided from a space into porous medium extending in tubular form vertically upward. The combustion takes place within the porous medium. The heat occurring during the combustion mainly flows downstream and reaches a further space. This process is not suitable for the combustion of liquid fuels. The position of the flame front in the porous body is unstable. In order to stabilize the position, an appliance coupled to a temperature measurement device is necessary to control the volume flow. The heat occurring in the known process is transferred incompletely by convection to the surrounding medium. No preheating of the combustion mixture to increase the efficiency takes place. After the process is switched off, gas or vapor residues remaining in the space can contribute in a disadvantageous manner to self-ignition.

An oil burner of the evaporative type is revealed in U.S. Pat. No. 4,133,632. In this oil burner, a porous plate is provided at the bottom of an evaporation casing, oil being induced on one side of the plate by capillary forces and evaporated into the evaporation casing on the other side. The evaporated oil is mixed with air and the mixture is finally supplied to a combustion space where it is burnt with an open flame.

The known evaporator is disadvantageous in a plurality of respects. Because the mixture with air only takes place after the evaporation of the oil, a large distance is required to form a homogeneous air/oil mixture. Because the induction of the oil into the porous plate depends on capillary forces, the porous plate must have a very fine-pored configuration. This, however, has the effect that it becames blocked due to the impurities contained in the oil and therefore has to be cleaned regularly. In order to make a sufficient quantity of oil vapor available, the porous plate must have a relatively large surface which is in contact over the whole of its surface with an oil reservoir. This requirement acts against a compact design of the known oil burner. In addition, it is not possible to put the burner which is combined with this evaporator into operation immediately because the formation of the oil vapor demands a certain time. After the burner is switched off, an oil vapor/air mixture remains in the evaporator and this can lead to unintentional combustion.

The object of the present invention is to obviate the disadvantage of the prior art. The object is, in particular, to provide a simple process for the combustion of liquid fuels, in particular oil, which process is as efficient as possible and has as low a pollutant level as possible. In addition, the object is to provide an appliance for the combustion of liquid fuels which is as simple and compact in design as possible and can be manufactured at low cost In accordance with the process aspect of the invention, provision is made for the liquid fuel to be distributed by means of a distribution device and to be transferred into a reactor arranged downstream with a porous medium having a communicative pore space, the Péclet number of which porous medium permitting flame development within the porous medium. The process according to the invention permits particularly efficient and low-pollutant combustion of the liquid fuel used.

It has been found advantageous to select a Péclet number of the porous medium which is greater than 65. The Péclet number can be calculated from the following equation:

$$Pe=(S_L d_m C_p \rho)/\lambda,$$

where $S_L$ is the laminar flame speed, $d_m$ is the equivalent diameter of the average hollow space of the porous material, $C_p$ is the specific heat of the gas mixture, $\rho$ is the density of the gas mixture and $\lambda$ is the thermal conductivity coefficient of the gas mixture. The equation shows that the conditions for the development of the flame are essentially dependent on the equivalent diameter $d_m$ of the mean hollow space or on the means pore diameter of the porous material. The process-dependent parameters, such as $S_L$, $C_P$, $\rho$ and $\lambda$ then have to be fixed for a specified oxidant/liquid fuel mixture under the porous medium conditions present at entry, i.e. in the region of the mixture inlet end. They are defined, in particular, by the type of liquid fuel and oxidant and by their mixture ratio. The process according to the invention has the noteworthy advantage that the thermal conductivity coefficient $\lambda$ and the temperature of the oxidant/liquid fuel mixture at entry into the porous medium does not necessarily have to be selected in such a way that they lie below the explosion limit.

In a further configuration according to the invention, a gaseous oxidant, in particular air, is supplied to the distribution device and/or the porous medium to form a mixture consisting of the liquid fuel and the oxidant. In this arrangement, the distribution device can have a device for atomizing the liquid fuel. The atomizing device can, for example, have a flow of gaseous oxidant around it. It is advantageous for the atomizing device to have a nozzle to which is supplied liquid fuel under pressure. The atomizing device can also have a binary nozzle to which is supplied liquid fuel and oxidant under pressure. By this means, a first mixture consisting of oxidant and liquid fuel is formed and this can be enriched with further oxidant.

The atomizing device is preferably arranged in the vicinity of the porous medium. It can be movable back and forth relative to the porous medium. In the case of a cylindrical configuration of the porous medium, the atomizing device is advantageously arranged on the axis of the cylinder.

In accordance with a further embodiment, the porous medium can be provided at a mixture inlet end with a porous element having a communicative pore space. The porous element is preferably defined by a Péclet number which does not permit flame development, this Péclet number being not generally less than 65.

In accordance with a particularly advantageous feature, a mixture evaporating device can be provided which preferably contains a porous body having a communicative pore space. The average pore diameter of the porous body can be greater than that of the porous element. This facilitates the distribution, mixing and evaporation of the liquid fuel. The evaporation device is generally arranged upstream of the porous medium and downstream of the distribution device.

In a further embodiment, the porous medium is in contact with the porous element. The porous element can usefully be in contact at its upstream end with the porous body. At the mixture inlet end of the porous medium, the porous element forms a flame barrier which prevents the mixture from burning back against the direction of the mass flow, in particular into the porous body acting as the evaporation device. Because of the direct contact between the porous body and the porous element and between the porous element and the porous medium, the heat formed in the porous medium due to the combustion is transmitted to the porous element and the porous body not only in the form of thermal radiation but also by means of thermal conduction. This ensures complete gasification of the mixture before entry into the porous medium.

The distribution device preferably has a means for generating liquid jets, it being possible for the latter and/or the atomizing device to protrude into a recess provided in the porous element or in the porous body. This permits a particularly compact design.

In order to permit particularly efficient process control, the oxidant and/or the liquid fuel and/or the evaporation device can be heated by means of a heating device. The heat necessary for the heating device is then preferably transferred from the hot combustion gases. It is, however, also possible to achieve heating of the oxidant by mixing in hot combustion gases.

The mixture can be ignited by means of an ignition appliance provided in the porous medium or in the evaporation device or in the vicinity of the distribution device. In the case of an ignition appliance provided in the vicinity of the distribution device, it can be preferable initially to ignite the mixture emerging from the distribution device and to permit open combustion in order to heat up the porous medium. The liquid fuel supply and therefore the open combustion is then interrupted. When liquid fuel is again supplied, the mixture forming ignites automatically in the preheated porous medium; open combustion no longer takes place.

In a further embodiment, the reactor has a casing which accommodates the porous medium, it being possible for the casing to surround the porous element and the evaporation device. The porous medium is preferably surrounded by a heat exchanger.

In accordance with a further embodiment feature, the porous medium is arranged below the distribution device in such a way that a counterflow directed against the mass flow is formed on the occurrence of combustion. This permits preheating of the mixture supplied by the mass flow. In addition, the counteflow retards the mass flow. This keeps the position of the flame front stable.

In accordance with a further measure of the invention, an appliance is provided for the combustion of liquid fuel, in particular oil, it being possible to distribute the liquid fuel by means of a distribution device and to transfer it into a reactor arranged downstream with a porous medium having a communicative pore space, and Péclet number of which porous medium permitting flame development within the porous medium. The appliance according to the invention can be manufactured in a compact shape simply and at low cost. It permits low-pollutant combustion of liquid fuel. The appliance according to the invention is characterized particularly by a large power range and modulation capability, by a wide range of air/fuel ratio and by a high specific power density.

Suitable materials for the manufacture of the porous medium and or of the porous element are metal, metal oxides, ceramic or ceramic-coated metal. Bulk materials and aggregate or individual elements, such as balls and the like, can also be employed. General criteria for the selection of material are constancy of shape, resistance to temperature change, chemical and thermal stability and the heat transport properties, for example the thermal conductivity or the thermal radiation coefficient.

Advantageous embodiments of the process and the appliance according to the invention are explained below using the drawing.

Figure 2:
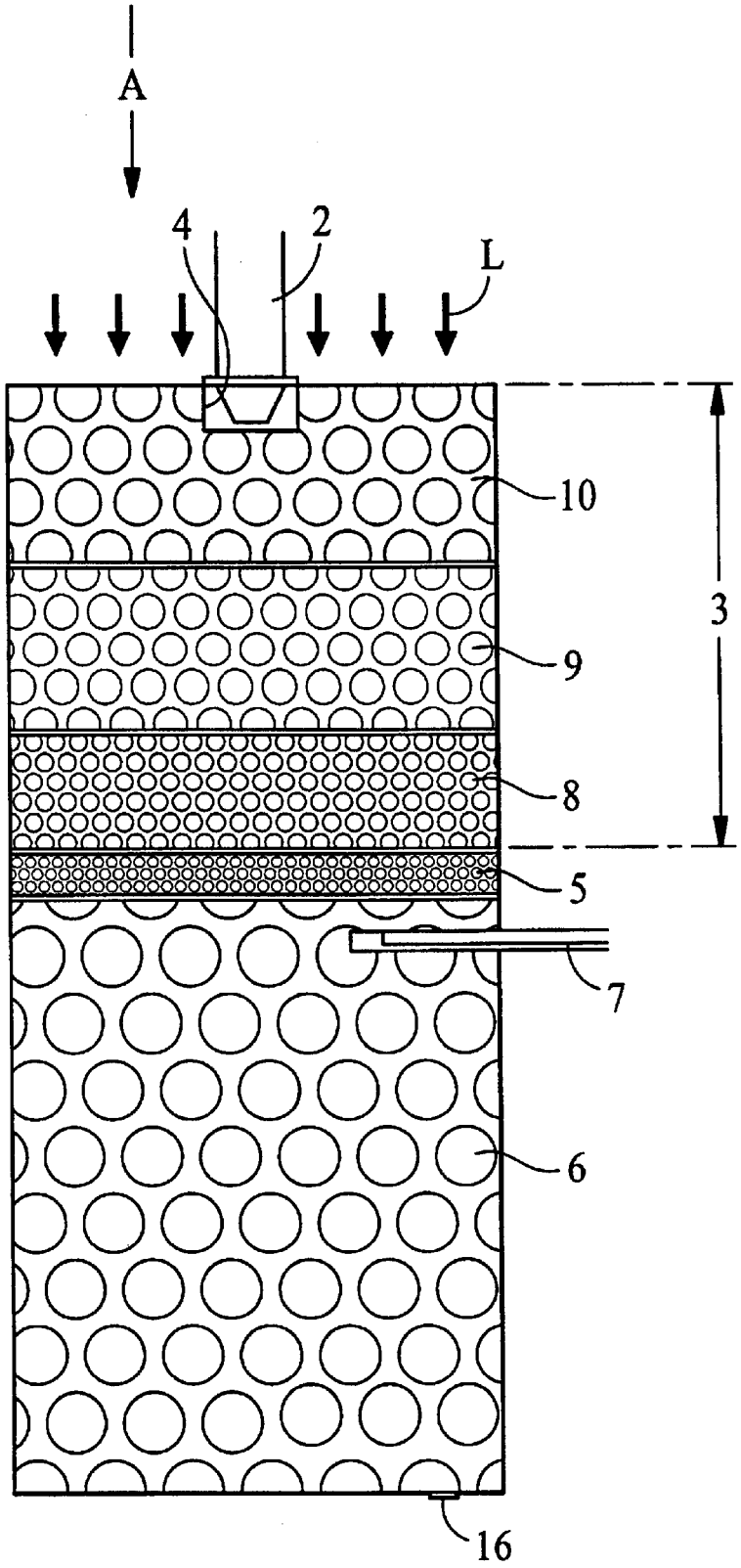
Figure 3:
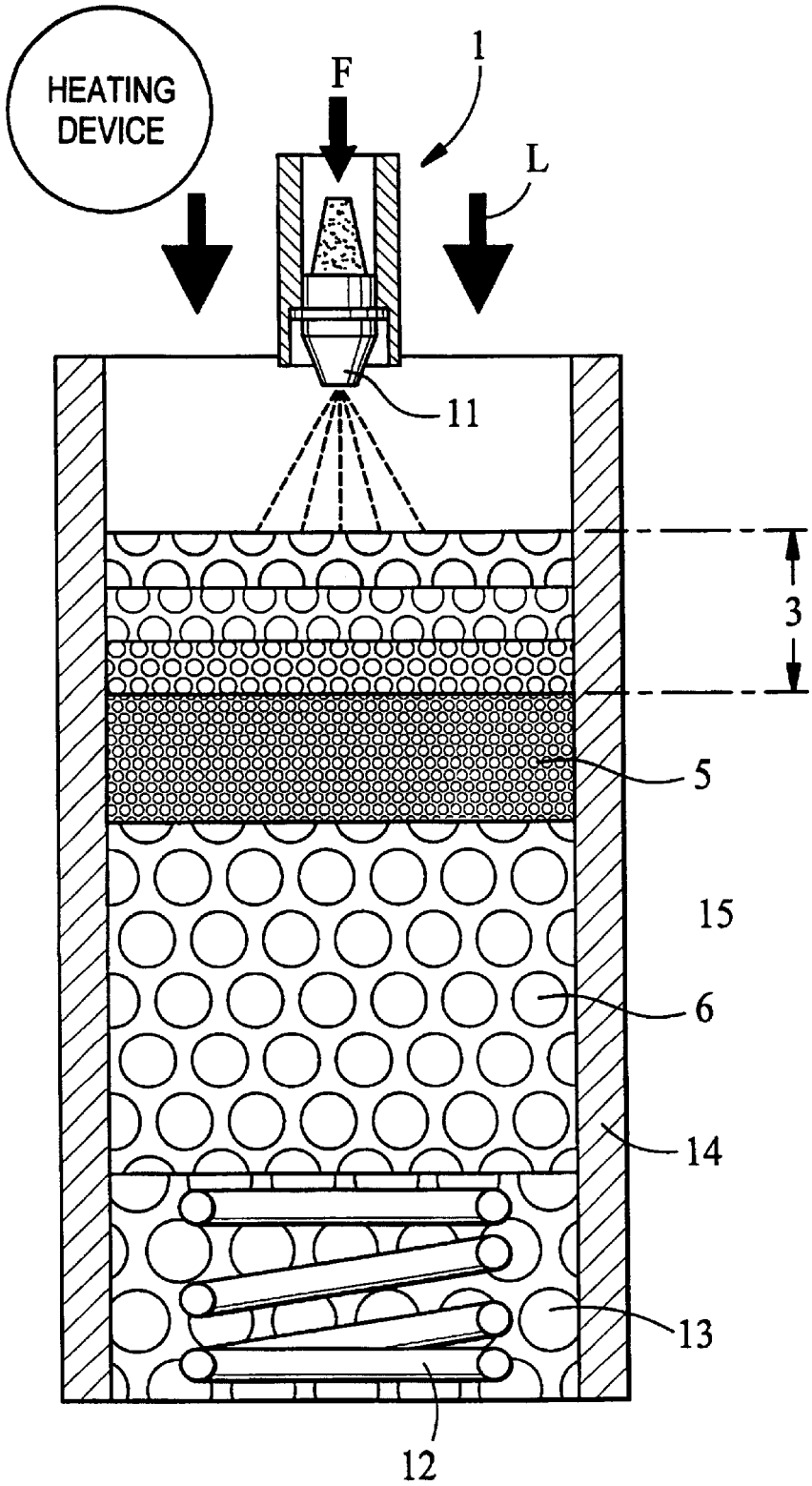
Figure 4:
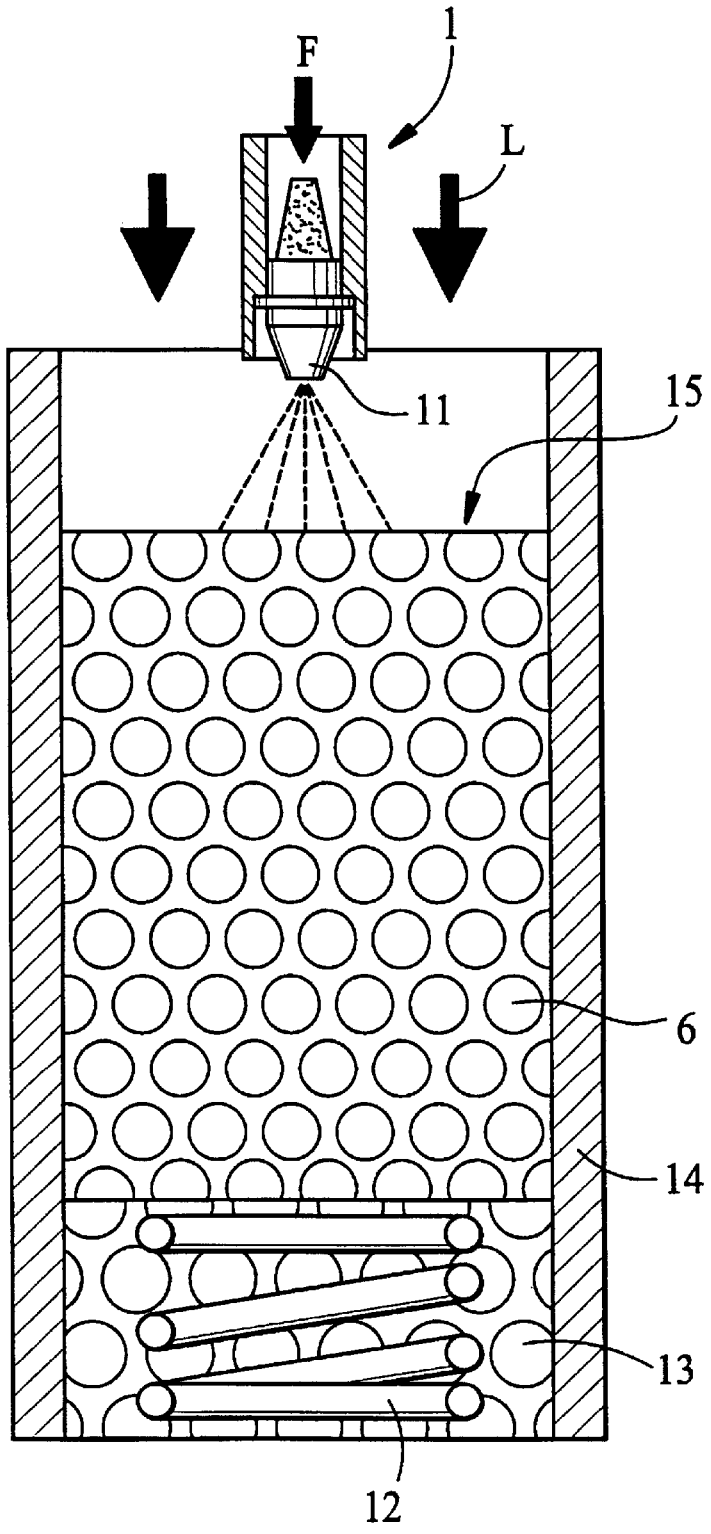
Figure 5A:
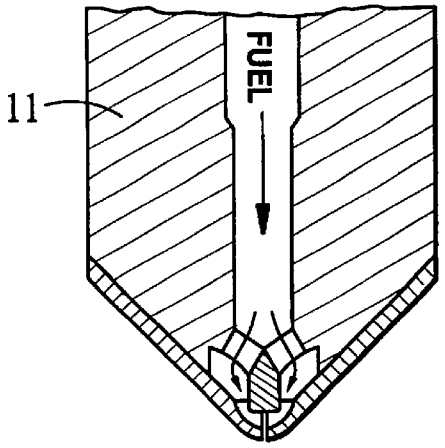
Figure 5B:
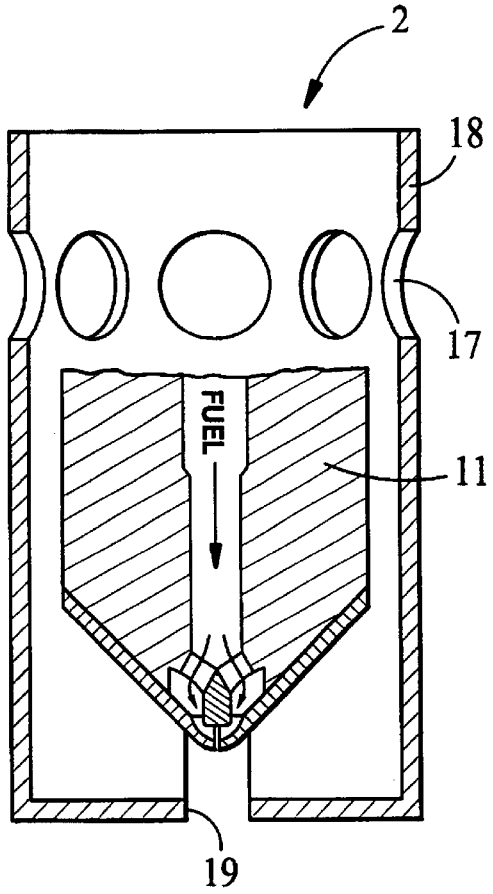
Figure 6A:
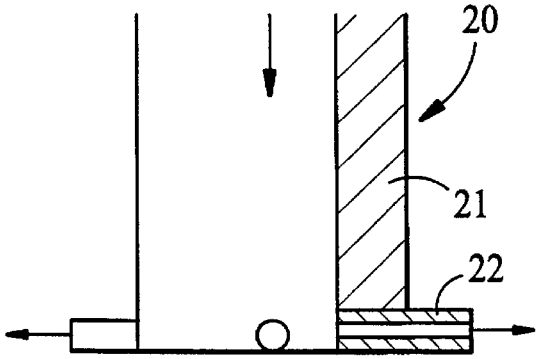
Figure 6B:
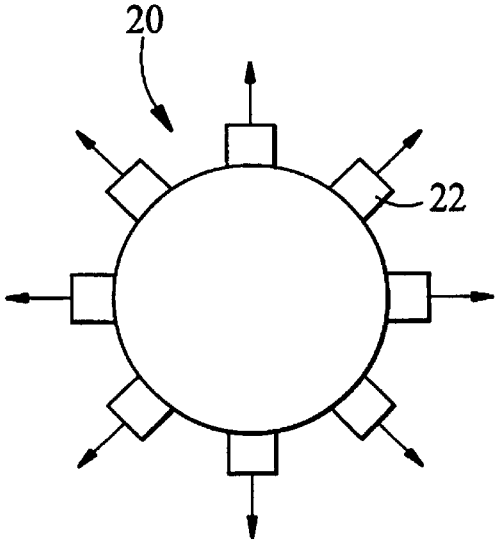

In this:

FIG. 1 shows a sketch to explain the principle of the process according to the invention, FIG. 2 shows a diagrammatic cross-section through a first embodiment example of an appliance according to the invention, FIG. 3 shows a diagrammatic cross-section through a second embodiment example of an appliance according to the invention, FIG. 4 shows a diagrammatic cross-section through a third embodiment example of an appliance according to the invention, FIG. 5*a* shows a cross-section through a liquid fuel nozzle, FIG. 5*b* shows a cross-section through a binary nozzle, FIG. 6*a* shows a diagrammatic cross-section through a distributor, and FIG. 6*b* shows a plan view onto the distributor of FIG. 6*a*.

FIG. 1 shows a sketch illustrating the principle of an embodiment variant of the process according to the invention. Liquid fuel, heated if necessary, is distributed in interaction with a porous body so that the surface area of the liquid fuel is increased. Air is simultaneously supplied to the porous body and this causes intimate mixing with the distributed liquid fuel. The mixture consisting of air and liquid fuel moves with the mass flow through the porous body in the direction of the porous medium, on whose mixture inlet end there is a porous element which acts as a flame barrier. By means of the combustion taking place in the porous medium, heat is transferred to the porous element, which is preferably in direct contact with the porous medium, and is transferred from there to the porous body. In consequence, the mixture moving through the porous body and the porous element is increasingly heated and evaporate or is converted into the gaseous phase. In this process, the mixture in the porous body is completely homogenised. The porous body, in particular, can be additionally heated in order to support the evaporation. The evaporated mixture finally reaches the porous medium and is burnt there.

In order to carry out the process according to the invention, a plurality of embodiments of the appliance according to the invention have been found to be particularly advantageous.

A first embodiment example of an appliance according to the invention is shown in FIG. 2. In this, a distribution device generally indicated by the designation 1 consists essentially of a distributor 2. The distributor 2 protrudes into a recess 4 provided on a porous body 3. The porous body 3 is in direct contact with a porous element 5 whose Péclet number is less than 65. The porous element 5 is, in turn, in direct contact with a porous medium 6. The porous medium 6 forming the burner is provided with an ignition appliance 7.

In this case, the porous body 3 has a plurality of zones or layers 8, 9 and 10 whose porosity and average pore diameters are different.

In accordance with a second embodiment form, which can be seen in FIG. 3, the distribution device 1 consists of a liquid fuel nozzle 11 which is arranged upstream and above the porous body 3. A heat exchanger 12, which is embedded in a coarse-pore element 13, is arranged downstream of the porous medium 6. The porous body 3, the porous element 5, the porous medium 6 and the coarse-pore element 13 are accommodated in a casing 14, which is here configured as a tube.

FIG. 4 shows a third embodiment with a particularly simple construction. In this, the porous medium 6 extends over a substantial section of the casing 14.

In this case, a mixture inlet end 15 of the porous medium 6 is directly subjected to liquid fuel emerging from the liquid fuel nozzle 11.

The function of the appliances described in FIG. 2 and 3 is as follows:

The air/liquid fuel mixture or liquid fuel emerging from the distribution device 1 passes into the porous body 3 and is there distributed radially over its complete cross-section. The mixture or the liquid fuel is simultaneously mixed and homogenised with air entering the porous body 3. In the further course of transport, further homogenisation and fine distribution of the mixture takes place. The mixture is finally evaporated under the action of the heat transferred from the porous medium 6. The vapor or the gasified mixture passes the porous element 5, which acts as a flame barrier, and finally reaches the porous medium 6 where it is burnt. The combustion gases are led away at the outlet end 16 of the porous medium 6 and guided via the heat exchanger 12.

In the case of the appliance shown in FIG. 4, the mixing, homogenisation and evaporation of the mixture takes place in the vicinity of the inlet end 15 of the porous body.

In the appliances shown in FIG. 2 to FIG. 4, the mass flow is directed vertically downward in each case. Because of the combustion, a counterflow occurs in the porous medium and this is directed vertically upward. The counterflow retards the mass flow. By this means, the position of the flame front in the porous medium is kept stable.

FIG. 5*a* and *b* show cross-sections through a liquid fuel nozzle 11 and through a binary nozzle 17. The binary nozzle 17 consists of a liquid fuel nozzle 11 which is surrounded by an air nozzle 18. The air nozzle 18 is provided with penetrations 19 for the induction of air. The air/liquid fuel mixture emerges through an opening 20 provided in the air nozzle 18.

FIG. 6*a* shows a cross section through a distributor 2. The latter consists essentially of a cylinder 21 whose internal space is in connection with the surroundings by means of radially arranged nozzles 22. The arrangement of the nozzles 22 can be seen particularly clearly from FIG. 6*b*.

List of designations

1 Distribution device
2 Distributor
3 Porous body
4 Recess
5 Porous element
6 Porous medium
7 Ignition appliance
8, 9, 10 Zones
11, Liquid fuel nozzles
12 Heat exchanger
13 Coarse-pore element
14 Casing
15 Mixture inlet end
16 Outlet end
17 Binary nozzle
18 Air nozzle
19 Penetration
20 Opening
21 Cylinder
22 Nozzle
A Direction of the mass flow
F Liquid fuel
L Air

What is claimed is:

1. A process for the combustion of liquid fuel (F), wherein the liquid fuel (F) is distributed by means of a distribution device (1) and is transferred into a reactor arranged downstream with a porous medium (6) having a communicative pore space, the Péclet number of the porous medium permitting flame development and complete combustion of the liquid fuel (F) within the porous medium (6), characterized in that a porous body (3) is provided for the evaporation of a mixture consisting of the liquid fuel and a gaseous oxidant, the device being arranged upstream of the porous medium (6) and downstream of the distribution device (1).

2. The process of claim 1, wherein the liquid fuel (F) is oil.

3. The process of claim 1, wherein the Péclet number of the porous medium (6) is greater than 65.

4. The process of claim 1, wherein a gaseous oxidant (L), is supplied to the distribution device (1) and/or the porous medium (6) to form a mixture comprising the liquid fuel (F) and the oxidant (L).

5. The process of claim 1, wherein said gaseous oxidant is air.

6. The process of claim 1, wherein the distribution device (1) comprises a device for atomizing the liquid fuel (F).

7. The process of claim 6, wherein the atomizing device has a nozzle (11) to which is supplied liquid fuel (F) under pressure.

8. The process of claim 6, wherein the atomizing device has a binary nozzle (17) to which is supplied liquid fuel (F) and oxidant (L) under pressure.

9. The process of claims 6, wherein the atomizing device is arranged in the vicinity of the porous medium (6).

10. The process of claim 1, wherein the porous medium (6) is provided, at its mixture inlet end (15), with a porous element (5) having a communicative pore space.

11. The process of claim 1, wherein the pore space of the porous element (5) has a Péclet number which does not permit flame development.

12. The process of claim 11, wherein the Péclet number of the porous element (5) is less than 65.

13. The process of claim 1, wherein the porous body (3) is heated by the thermal radiation formed in the porous medium (6).

14. The process of claim 10, wherein the porous body (3) has a communicative pore space whose average pore diameter is larger than that of the porous element (5).

15. The process of claim 10, wherein the porous medium (6) is in contact with the porous element (5).

16. The process of claim 10, wherein the porous element (5) is in contact with the porous body (3).

17. The process of claim 1, wherein the distribution device (1) comprises means for generating liquid jets (2).

18. The process of claim 17, wherein the porous medium (6) is provided, at its medium inlet end (15), with a porous element (5) having a communicative pore space, and wherein the means for generating liquid jets (2) protrudes into a recess (4) provided in the porous element (5) or porous body (3).

19. The process of claim 6, wherein the porous medium (6) is provided, at its mixture inlet end (15), with a porous element (5) having a communicative pore space, and wherein the atomizing device (11) protrudes into a recess (4) provided in the porous element (5) or porous body (3).

20. The process of claim 1, wherein the oxidant (L), liquid fuel (F) and or the evaporation device is/are heated by means of a heating device.

21. The process of claim 20, wherein the heating power of the heating device is obtained from the enthalpy of the combustion gases.

22. The process of claim 1, wherein the mixture is ignited by means of an ignition appliance (7) provided in the porous medium (6) or in the evaporation device or in the vicinity of the distribution device (1).

23. The process of claim 1, wherein the reactor has a casing (14) accommodating the porous medium (6).

24. The process of claim 23, wherein the porous medium (6) is provided, at its mixture inlet end (15), with a porous element (5) having a communicative pore space, and wherein the casing (14) surrounds the porous element (5) and the evaporation device.

25. The process of claim 1, wherein a macroporous element (13) with a heat exchanger (12) embedded within it is provided downstream of the porous medium (6).

26. The process of claim 1, wherein the porous medium (6) is arranged below the distribution device (1) so that a counterflow directed against the mass flow is formed on the occurrence of combustion.

27. An appliance for the combustion of liquid fuel, wherein the liquid fuel (F) can be distributed by means of a distribution device (1) and can be transferred into a reactor arranged downstream with a porous medium (6) having a communicative pore space, the Péclet number of the porous medium permitting flame development and complete combustion of the liquid fuel (F) within the porous medium (6), characterized in that a porous body (3) is provided for the evaporation of a mixture consisting of the liquid fuel (F) and a gaseous oxidant, the device being arranged upstream of the porous medium (6) and downstream of the distribution device (1).

28. The appliance of claim 27, wherein said liquid fuel (F) is oil.

29. The appliance of claim 27, wherein the Péclet number of the porous medium (6) is greater than 65.

30. The appliance of claim 27, wherein the distribution device (1) and/or the porous medium (6) has a supply arrangement for a gaseous oxidant (L), to form a mixture consisting of the liquid fuel (F) and the oxidant (L).

31. The appliance of claim 30, wherein the gaseous oxidant is air.

32. The appliance of claim 27, wherein the distribution device (1) has a device for atomizing the liquid fuel (F).

33. The appliance of claim 32, wherein the atomizing device has a nozzle (11) to which can be supplied liquid fuel (F) under pressure.

34. The appliance of claim 32, wherein the atomizing device has a binary nozzle (17) to which can be supplied liquid fuel (F) and oxidant (L) under pressure.

35. The appliance of claim 32, wherein the atomizing device is arranged in the vicinity of the porous medium (6).

36. The appliance of claim 27, wherein the porous medium (6) is provided, at its mixture inlet end (15), with a porous element (5) having a communicative pore space.

37. The appliance of claim 36, wherein the pore space of the porous element (5) has a Péclet number which does not permit flame development.

38. The appliance of claim 37, wherein the Péclet number of the porous element (5) is less than 65.

39. The appliance of claim 27, wherein the porous body (3) can be heated by the thermal radiation formed in the porous medium (6).

40. The appliance of claim 36, wherein the porous body (3) has a communicative pore space whose average pore diameter is greater than that of the porous element (5).

41. The appliance of claim 36, wherein the porous medium (6) is in contact with the porous element (5).

42. The appliance of claim 36, wherein the porous element (5) is in contact with the porous body (3).

43. The appliance of claim 27, wherein the distribution device (1) comprises means for generating liquid jets (2).

44. The appliance of claim 43, wherein the porous medium (6) is provided, at its mixture inlet end (15), with a porous element (5) having a communicative pore space, and wherein the means for generating liquid jets (2) protrudes into a recess (4) provided in the porous element (5) or porous body (3).

45. The appliance of claim 32, wherein the porous medium (6) is provided, at its mixture inlet end (15), with a porous element (5) having a communicative pore space, and wherein the atomizing device (11) protrudes into a recess (4) provided in the porous element (5) or porous body (3).

46. The appliance of claim 32, wherein a heating device is provided to heat the oxidant (L) and/or the liquid fuel (F) and/or the evaporation device.

47. The appliance of claim 46, wherein the heating device can be heated by the enthalpy of the combustion gases.

48. The appliance of claim 32, wherein an ignition appliance (7) for igniting the mixture is provided in the porous medium (6), in the evaporation device or in the vicinity of the distribution device (1).

49. The appliance of claim 32, wherein the reactor has a casing (14) accommodating the porous medium (6).

50. The appliance of claim 49, wherein the porous medium (6) is provided, at its mixture inlet end (15), with a porous element (5) having a communicative pore space, and wherein the casing (14) surrounds the porous element (5) and the evaporation device.

51. The appliance of claim 32, wherein a macroporous element (13) with a heat exchanger (12) embedded within it is provided downstream of the porous medium (6).

52. The appliance of claim 32, wherein the porous medium (6) is arranged below the distribution device (1) so that a counterflow occurring on combustion is directed against the mass flow.

* * * * *

UNITED STATES PATENT AND TRADEMARK OFFICE

CERTIFICATE OF CORRECTION

PATENT NO. : 6,257,868 B1 
DATED : July 10, 2001
INVENTOR(S) : Miroslaw Weclas, Michael Keppler and Franz Durst It is certified that error appears in the above-identified patent and that said Letters Patent is hereby corrected as shown below:

Column 8,
Line 51, please delete “32” and insert -- 27 -- therefor.
Line 54, please delete “32” and insert -- 27 -- therefor.

Signed and Sealed this

Sixth Day of August, 2002

*Attest:*

*Attesting Officer*

JAMES E. ROGAN
*Director of the United States Patent and Trademark Office*